US006848805B2

(12) United States Patent
Pietz

(10) Patent No.: US 6,848,805 B2
(45) Date of Patent: Feb. 1, 2005

(54) ILLUMINATION DEVICE FOR PEDESTRIAN CONVEYOR SYSTEMS

(75) Inventor: Alexander Pietz, Berlin (DE)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 10/791,689

(22) Filed: Mar. 3, 2004

(65) Prior Publication Data

US 2004/0201981 A1 Oct. 14, 2004

Related U.S. Application Data

(63) Continuation of application No. PCT/EP02/09759, filed on Sep. 2, 2002.

(30) Foreign Application Priority Data

Sep. 3, 2001 (DE) ..... 101 43 128

(51) Int. Cl.[7] ..... F21S 8/00
(52) U.S. Cl. ..... 362/146; 362/800
(58) Field of Search ..... 362/146, 145, 362/147, 152, 800; 361/748–750, 807–812; 174/250, 251; 428/212; 198/334, 335, 337

(56) References Cited

U.S. PATENT DOCUMENTS 5,040,659 A * 8/1991 Saito et al. ..... 198/324
5,339,228 A * 8/1994 Baethge et al. ..... 362/146

FOREIGN PATENT DOCUMENTS

DE 199 57 680 6/2001

OTHER PUBLICATIONS

Patent Abstracts of Japan, vol. 1996, No. 04 dated Apr. 30, 1996.
Patent Abstracts of Japan, vol. 017, No. 628, Nov. 19, 1993.
Patent Abstracts of Japan, vol. 016, No. 026, Jan. 22, 1992.

* cited by examiner

*Primary Examiner*—Alan Cariaso
*Assistant Examiner*—Mark Tsidulko
(74) *Attorney, Agent, or Firm*—Venable LLP; Robert Kinberg

(57) ABSTRACT

An illumination device for a pedestrian conveyor system having a glass balustrade includes a lighting element arranged on the glass balustrade. An electric strip conductor is printed on the glass balustrade and coupled to the lighting element for supplying power to the lighting element.

14 Claims, 1 Drawing Sheet

ILLUMINATION DEVICE FOR PEDESTRIAN CONVEYOR SYSTEMS

CROSS REFERENCE TO RELATED APPLICATIONS

This application is a continuation of International Application No. PCT/EP02/09759, filed on Sep. 2, 2002, which claims priority to German Application No. DE 101 43 128.7, filed on Sep. 3, 2001, both of which are incorporated herein by reference.

BACKGROUND OF THE INVENTION

1. Field of the Invention

The present invention relates to an illumination device for pedestrian conveyor systems having glass segments.

2. Related Art

German Patent Application No. DE-A 199 57 680 describes an illumination device for pedestrian conveyor systems, in particular an escalator or a moving walkway, comprising at least one continuous light band, which extends in the operational state essentially over the length of the pedestrian conveyor system, and which is formed by contiguous luminous diodes. The light band can be formed by a plurality of electrically connected boards, which are provided with luminous diodes, wherein the single luminous diodes can alternatively also be placed on a continuous, flexible, conductive band.

This type of illumination of components, such as balustrades of pedestrian conveyor systems, has to be considered as considerably easier and safer in comparison to lamps, which have been used so far and which are operated with a current of 220 V. However, the described illumination device requires considerable cabling work, in particular seen over the length of the pedestrian conveyor systems.

Japanese Patent Application JP-A 07 330270 discloses a glass balustrade for a pedestrian conveyor system, in particular an escalator. The same is formed with liquid crystal glass. Applying a voltage will excite the liquid crystals so that diverse patterns can be created, as seen in longitudinal direction of the balustrade, which addresses the decorative as well as the technical lighting aspect.

Japanese Patent Application JP-A 05 193886 discloses a balustrade for an escalator or a moving walkway. The balustrade cooperates via a fitted-on receiving element with a handrail guide as well as with a illumination device provided next to the balustrade.

German Patent Application DE-A 199 57 680 discloses an illumination device for pedestrian conveyor systems, comprising at least one continuous light band, which extends in an operational state essentially over the length of the pedestrian conveyor system, and which is formed by contiguous luminous diodes. The same is provided inside a channel in the base and/or handrail area.

A similar system as described in the above is also disclosed in the Japanese Patent Application, JP-A 03238290, wherein an illumination device is also mounted a channel on the handrail side and this channel can be attached to the balustrade.

SUMMARY OF THE INVENTION

It is an object of the invention to provide an illumination without cables of single or several components of pedestrian conveyors, such as in particular balustrades made of glass for escalators or moving walkways, which illumination has a simple configuration and is still safer in comparison to the state of the art, which has been known so far. Illumination devices for this purpose shall be considered those, which provide sufficient light for safety elements or an emergency lighting, as well as those, which have such a high light efficiency that a transport of passengers without any problems and without impairment of safety is assured.

The above and other objects are achieved according to the invention by the provision of an illumination device for a pedestrian conveyor system having a glass balustrade, comprising: a lighting element arranged on the glass balustrade; and an electric strip conductor printed on the glass balustrade and coupled to the lighting element for supplying power to the lighting element.

The present invention provides an illumination device without cables. Advantageously, components made of glass in a pedestrian conveyor system, such as an elevator, escalator and moving walkway, can be printed in a simple manner with the strip conductors and/or the lighting elements, wherein the screen printing can be advantageously used.

In an exemplary embodiment of the invention, screen printed lighting elements in the form of light emitting diodes LEDs or the like are used.

According to an exemplary embodiment of the invention, the illumination device is provided in the protected area of the components to be provided therewith, so that vandalism can be avoided. In the case of glass balustrades of escalators and moving walkways, this can be a part of the balustrade opposite the transport area, which part is not directly exposed to passenger access.

The printed strip conductors and/or lighting elements are hardly visible for the observer, so that the impression is given that parts of the pedestrian conveyor system can be illuminated without a supply of electricity. For protection against corrosion or avoiding short circuits or possible losses of voltage, the strip conductors and/or lighting elements are provided in encapsulated form, with different materials being used for this purpose. It is possible to provide the strip conductors, which preferably contain silver or a silver alloy, with a ceramic or plastic protective layer in order to obtain the desired effects.

In an exemplary embodiment of the invention where safety elements, such as warning signs or the like, shall only be provided at certain places of the pedestrian conveyor system, it is possible to use materials generating phosphorescent properties, such as for example zinc oxide, in the area of the lighting elements. These measures enable different color contrasts to be obtained in a selected range of light wave lengths.

BRIEF DESCRIPTION OF THE DRAWINGS

The present invention is represented in the drawing by means of an exemplary embodiment and described as follows.

DETAILED DESCRIPTION OF THE INVENTION

Figure 2:
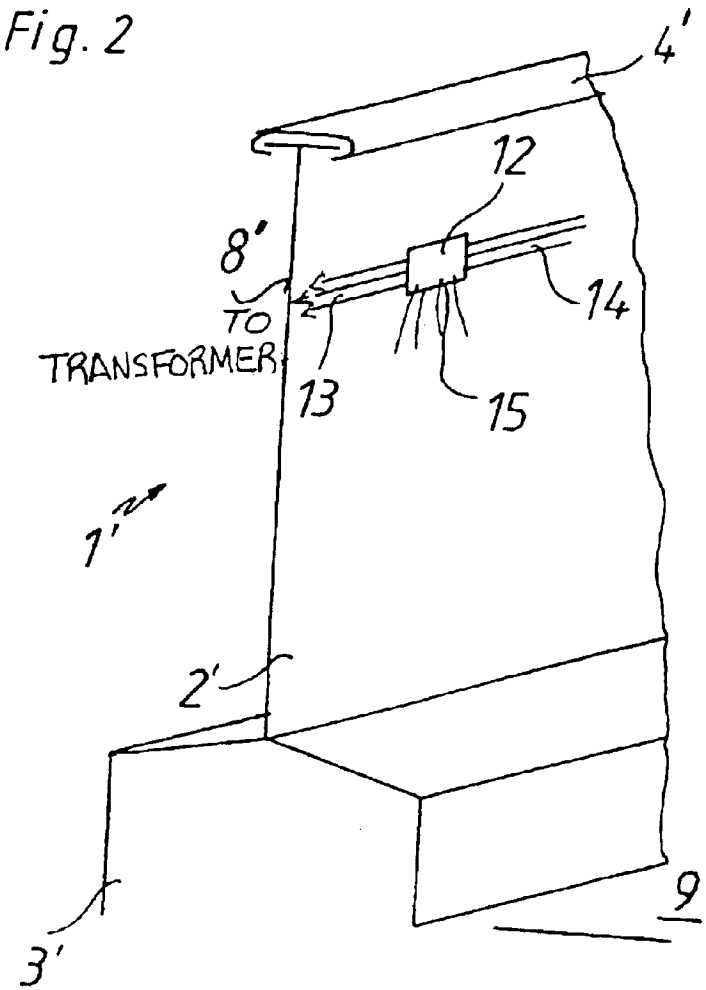
FIG. 2 depicts another exemplary embodiment of the illumination of the glass balustrade of a pedestrian conveyor system according to the invention.
Figure 1:
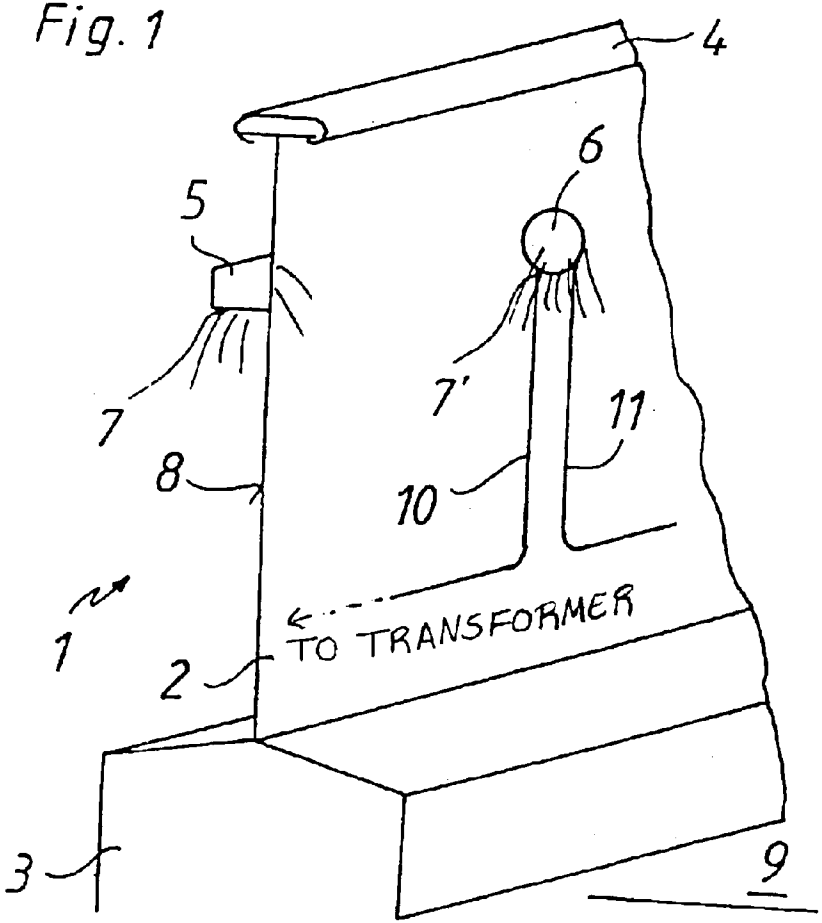
FIG. 1 depicts an exemplary embodiment of the illumination of the glass balustrade of a pedestrian conveyor system according to the invention.

Referring now to the drawings, FIGS. 1 and 2 show the balustrade area 1, 1' of an escalator or a moving walkway graphically represented by a transport area 9. In both cases, the balustrade 2, 2' is made of glass. The balustrade 2, 2' is fixed at a base 3, 3' and, outside the base 3, 3', the balustrade 2, 2' supports a handrail 4, 4'. In FIG. 1, for example, two different illumination devices 5, 6 are represented. Device 5 is formed by a chain of LEDs 7, which is fixed in an outer area 8 of balustrade 2 opposite the transport area, but which also diffuses its light, among other things, into the transport area 9.

LEDs 7 are coupled to a transformer (not shown) via electric strip conductors (not shown). The illumination device 6 is formed by a safety element 7', which is also coupled via electric strip conductors 10, 11, to a transformer for generating a 12V alternating current. While the illumination device 5 diffuses sufficient light for the safe transport of passengers, seen over the transport distance, the illumination device 6, which can optionally contain means comprising phosphorescent properties for the generation of different shades of color, is only provided for the specific purpose of supplying information. In both cases, the strip conductors 10, 11 are applied on the balustrade 2 by means of for example screen printing, wherein the strip conductors 10, 11 contain silver and are coated with a protective layer made of plastic (not shown).

The illumination device 12 represented in FIG. 2, for example, also comprises electric strip conductors 13, 14 as well as a plurality of LEDs 15 for the generation of a continuous light band, seen over the transport distance. The light band, which is formed by the LEDs 15, provides sufficient light for the safe transport of passengers. For reasons of vandalism, the electric strip conductors 13, 14 as well as the illumination device 12 are applied on the rear side 8' of the balustrade 21 by screen printing, wherein the strip conductors 13, 14 are coupled to a 12 V alternating current transformer.

The subject of invention is not limited to the represented embodiments, but it can also be used for elevators, in particular in elevator cars, which are at least partially equipped with glass elements. Herein, the illumination devices can be fixed at the non accessible side of the elevator car for safety reasons and for avoiding vandalism and can produce the desired effects (information, illumination or the like).

The embodiments illustrated and discussed in this specification are intended only to teach those skilled in the art various ways known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that the invention may be practiced otherwise than as specifically described.

What is claimed is:

1. An illumination device for a pedestrian conveyor system having a glass balustrade, comprising:

a lighting element arranged on the glass balustrade; and an electric strip conductor printed on the glass balustrade and coupled to the lighting element for supplying power to the lighting element.

2. The illumination device according to claim 1, wherein the electric strip conductor is screen printed on the glass balustrade.

3. The illumination device according to claim 1, wherein the electric strip conductor and the lighting element located on a side of the balustrade facing away from passenger area of the pedestrian conveyor system.

4. The illumination device according to claim 1, wherein the electric strip conductors comprise at least one of silver and a silver alloy, covered with a protective layer on a side of the balustrade facing away from a passenger area of the pedestrian conveyor system.

5. The illumination device according to claim 4, wherein the protective layer comprises one of ceramic and plastic.

6. The illumination device according to claim 1, wherein the lighting element is a light emitting diode (LED).

7. The illumination device according to claim 1, further comprising:

at least one transformer coupled to the electric strip conductors for reducing voltage to a 12V alternating current.

8. The illumination device according to claim 1, wherein the light element comprises powdery zinc sulphate for generating phosphorescent properties in a selected range of wavelengths.

9. The illumination device according to claim 1, wherein the strip conductors comprise encapsulated electrodes and the lighting element is provided on a base of the encapsulated electrodes to form of a sandwich for generation and representation of colored safety symbols.

10. The illumination device according to claim 1, wherein the pedestrian conveyor system is an escalator.

11. The illumination device according to claim 1, wherein the pedestrian conveyor system is a moving walkway.

12. The illumination device according to claim 1, wherein the lighting element is printed on the balustrade.

13. The illumination device according to claim 2, wherein the lighting element is screen printed on the glass balustrade.

14. The illumination device according to claim 1, wherein the lighting element is a strip-shaped lighting element.

* * * * *